United States Patent [19]

Foresto

[11] 4,430,950

[45] Feb. 14, 1984

[54] INCINERATOR

[76] Inventor: Sam Foresto, 243 Willis Ave., Mineola, N.Y. 11501

[21] Appl. No.: 404,665

[22] Filed: Aug. 3, 1982

[51] Int. Cl.[3] ..... B09B 3/00

[52] U.S. Cl. ..... 110/235; 110/214; 110/245; 110/211; 110/208; 110/248

[58] Field of Search ..... 110/235, 248, 208, 252, 110/209, 315, 211, 245, 214, 224, 227

[56] References Cited

U.S. PATENT DOCUMENTS

| | | | |
|---|---|---|---|
| 167,078 | 8/1875 | Durfee . | |
| 346,086 | 7/1886 | Bujac . | |
| 438,704 | 10/1890 | Mueller . | |
| 451,961 | 5/1891 | Trowbridge | 110/208 |
| 731,555 | 6/1903 | Emy | 110/208 |
| 773,920 | 11/1904 | Boulger . | |
| 1,149,739 | 8/1915 | Devore . | |
| 1,315,582 | 9/1919 | Stacy | 110/214 |
| 1,479,875 | 1/1924 | Shaughnessy . | |
| 1,533,686 | 4/1925 | Bolmer | 110/214 |
| 1,607,312 | 11/1926 | Schierenbeck . | |
| 2,361,796 | 10/1944 | Schrage . | |
| 3,509,834 | 5/1970 | Rosenberg et al. . | |
| 3,745,941 | 7/1973 | Reilly . | |
| 3,780,674 | 12/1973 | Liu | 110/248 |
| 4,027,602 | 6/1977 | Mott . | |
| 4,075,953 | 2/1978 | Sowards | 110/245 |
| 4,205,614 | 6/1980 | Good . | |
| 4,317,417 | 3/1982 | Foresto | 110/211 |

*Primary Examiner*—Henry C. Yuen

*Attorney, Agent, or Firm*—Nolte and Nolte

[57] ABSTRACT

An incinerator for burning waste material employs an additional grate on which waste material is burned, thereby producing a layer of heated ashes and coke. The smoke and gases produced by the burning waste material are caused to be passed downwardly through this very hot layer of coke, thereby raising the temperature of the waste gases and burning off noxious pollutants entrained therein. The invention also provides a series of burning stations with adjacent ones burning in opposite directions; i.e., upwardly and downwardly. All waste gases and smoke produced by the burning waste material will pass sequentially through the series of burning stations, all of which will have a layer of hot coke, before being exhausted to the atmosphere. Fresh air blowers, fans, burners, and baffles are employed to cause the burning of the waste material in the additional station to be in a downward direction and to cause the waste gases produced in preceding stations to pass downwardly through the heated coke layer in the additional burning station. Air-injection tubes are used to provide air to the layers of waste material to aid in the combustion thereof.

21 Claims, 6 Drawing Figures

INCINERATOR

BACKGROUND OF THE INVENTION

The present invention relates to incinerators in general and, specifically, relates to improved incinerators whereby the waste gases are raised to a high temperature in order to eliminate particles of pollutants and noxious gases from the incinerator exhaust gases.

In known incinerators the waste material is dumped or deposited on grates or the like and consumed by burning. The exhaust gases from the burning waste material are permitted to go up the chimney or flue of the incinerator. An ash pit or the like is arranged beneath the grate to catch the ashes.

In known incinerators, the waste materials are substantially consumed in the burning process, and the waste gases permitted to escape up the flue. Such waste gases, therefore, include a relatively large amount of particulate pollutants, which may be reduced to a certain extent by precipitators or the like, and also a relatively large amount of gasified pollutants that are generally noxious. These noxious gases may be reduced to a certain extent by the use of scrubbers or the like. Nevertheless, the overwhelming majority of incinerator installations contain neither a particle precipitator nor a gas scrubber.

SUMMARY OF THE INVENTION

The present invention provides an improved incinerator that both reduces the particle pollutants in the incinerator waste gases and also reduces noxious gasified pollutants in such waste gases. The present invention can be added to an existing incinerator or can be included in the incinerator design when building a new incinerator.

The invention teaches the secondary heating of the waste gases by means of an additional burning station or stations. The additional or secondary burning stations are constructed in such a way that the waste materials burn in a downward direction, with the waste gases from the preceding burning stations being passed through the heated ash and coke in a subsequent burning station, thereby raising the temperature of the original waste gases. When a plurality of heating sections is employed, the initial heating section has the waste gases and waste materials burning conventionally in an upwards orientation, whereas in the secondary station, the waste materials burn in a downward direction and, thus, the waste gases pass downwardly therethrough. Because the flames and gases produced in this secondary station are reversed, they pass down through the heated ashes and coals and, thus, tend to be self-cleaning. The present invention teaches the use of perforated tubes arranged on the grid holding the waste material to provide oxygen, as contained in the air, to the middle portions or center of the layer of waste materials being combusted.

The present invention also teaches that the incinerator and secondary burning stations can be used in conjunction with a heat exchanger to utilize some of the heat being generated by the burning of the waste material.

Following the teachings of the present invention it is possible to raise the temperature of the waste gases to between 2300°–3000° F. This is sufficient to heat the exhaust gases to a point which will burn off the noxious gasified pollutants. The present invention also teaches that in order to reduce such the undesirable pollutants, these high temperatures should be maintained for as long as possible. Thus, by passing the exhaust gases back through additional burning stations it is possible to maintain these waste gases at the elevated temperature for a much longer period than heretofor possible.

Therefore, it is an object of the present invention to provide incinerator apparatus to reduce particulate pollutants in incinerator waste gases by providing additional burning stations for waste materials and passing the waste gases through additional, downwardly burning waste material that has formed a layer of heated ash and coke.

It is another object of the present invention to reduce noxious gasified pollutants in incinerator waste gases by passing the gases through additional burning stations wherein waste materials are being combusted and which have a layer of heated ash and coke.

It is a further object of the present invention to reduce pollutants in incinerator waste gases by providing additional burning stations and wherein the waste gases are passed in an upward direction through the heated ash and coke of one waste material burning section and in a downward direction through the heated ash and coke of a subsequent waste material burning station.

It is still a further object of the present invention to provide an air-injection tube for use in an incinerator to provide air to the center layer of burning material.

The manner in which these and other objects are accomplished by the present invention will be set forth in the following detailed description.

BRIEF DESCRIPTION OF THE DRAWINGS

FIG. 6 is a perspecitve view of another embodiment showing a multi-level incinerator adapted to practice the present invention.

DETAILED DESCRIPTION OF THE INVENTION

Figure 1:
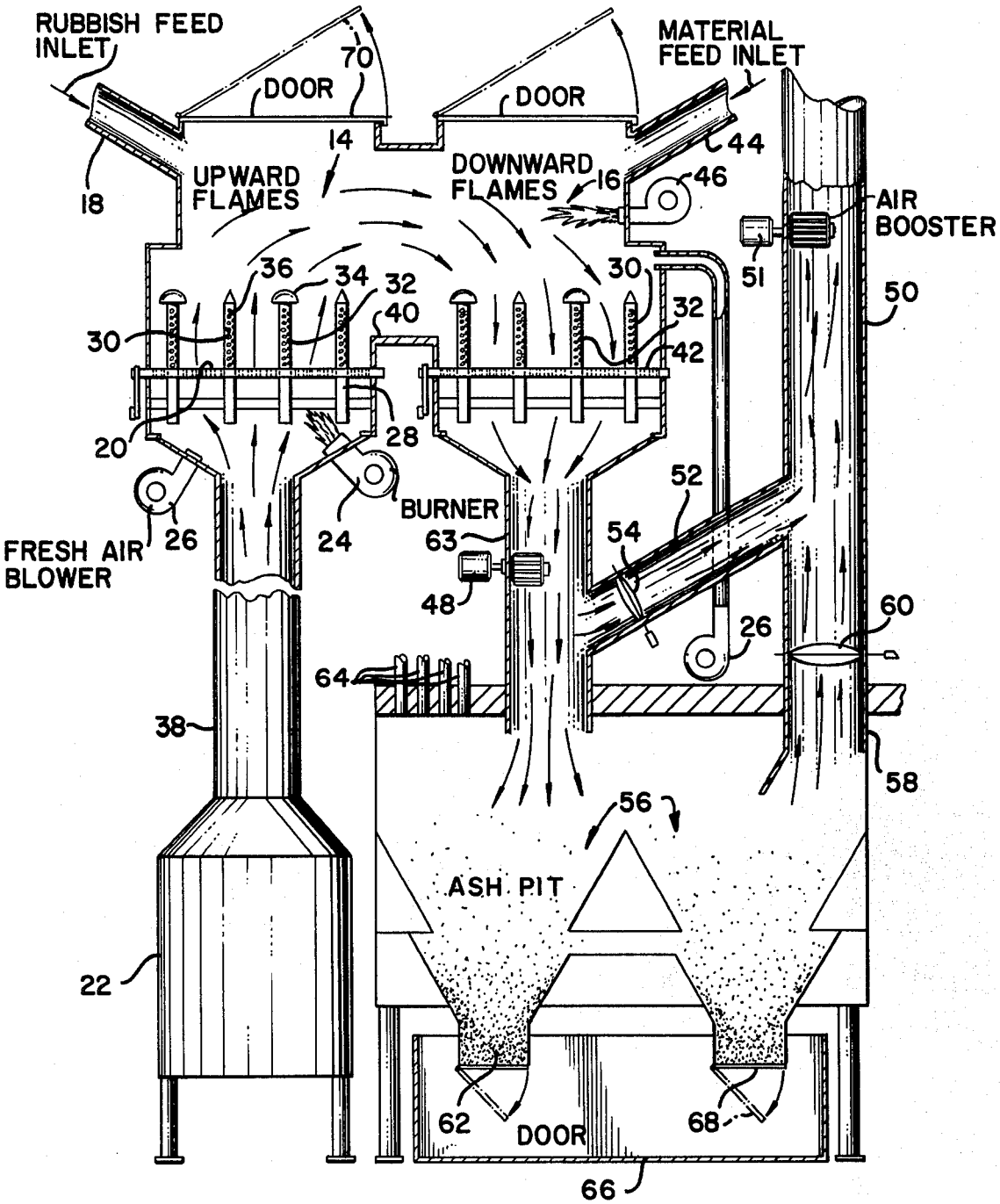
FIG. 1 is a schematic representation of a side elevation of an incinerator employing the present invention.

FIG. 1 shows the present invention having a single enclosure involving two burning stations and installed on an existing incinerator or on any other system that produces waste gases from burning. That is, the waste gas and particulate cleaning apparatus taught in the present invention comprises two separate burning locations, 14 and 16. In the embodiment of FIG. 1, a first rubbish feed inlet 18 is arranged at the top of the incinerator and the rubbish and waste material is fed in and falls downwardly onto a grate 20. Drying and initial combustion of the rubbish on the grate 20 is accomplished by an external source of heat 22, which can be a fire box burning coal, wood, oil, or any fuel sufficient to raise the temperature of the rubbish laying on the grate 20 to a temperature high enough to commence burning.

Fire box 22 can be any existing source that produces noxious waste gases. Such burning of the rubbish or waste material is aided by a burner 24 that can be a gas jet or the like, and by a fresh air blower 26 that provides additional oxygen to aid combustion of the waste material lying on the grate 20. Because the rubbish and waste material will be fed to the initial burning station faster than it can be consumed by the fire, layers of this waste material will build up on the grate 20. In order to provide oxygen to the interior of this build-up, a number of perforated pipes or air-injection tubes are provided. There are two kinds of these air-injection tubes, those tubes 30 with closed ends, and those tubes 32 with open ends covered with metal domes or shields 34. Each of these tubes has a plurality of holes 36 formed in the wall thereof. In tube 34 the upper end is open but is protected from being clogged by falling waste material by a cap or dome shaped metal shield 32 that is affixed to the tube 28 and protects the open end of the tube. These tubes 30, 32 will be shown in more detail hereinbelow.

In operation of the system described so far, the heat from the fire box 22 passes upward through a flue 38, through the grate 20 and dries and ignites the waste material which has been deposited thereon. Air to promote combustion is fed to the layers of burning waste material on grate 20 by the tubes 30, 32 and by the fresh air blower 26. In this fashion, the rubbish and other waste materials on the grate 20 will be substantially consumed. This then leaves the situation, as in the past, wherein the gases from this burning waste material contain noxious gasified pollutants and other particulate pollutants. At this point conventional incinerators vent the waste gases out a flue and up the chimney to the atmosphere.

The present invention not only provides an additional, downwardly directed burning station, but also improves the degree of combustion of the waste materials at this initial burning station. To encourage the burning of the rubbish and the like deposited upon the grate system 20 the burner 24 and the fresh air booster 26 are provided, the booster 26 and the air-injection tubes 30, 32 aiding the introduction of oxygen into the mass of the burning medium. If the burning medium should pack too densely then, absent the air-injection tubes, air will be unable to penetrate it, and it will be impossible to create a suitable combustion within the internal volume of the densely packed medium. It is the purpose of the tubes 30, 32 to aid in the introduction of oxygen into the center of the mass of the burning medium. The perforations 36 along the length of these tubes serve to permit the air to enter the center of the medium. The present invention takes into account the possibility that upper ends of the tubes may reside beneath the burning waste material. The specific structure of these air-injection tubes will be set forth in detail hereinbelow.

The present invention teaches the filtering and scrubbing of the waste gases from the burning process by passing the gases through a layer of heated ash and coke formed by burning waste material in a downwardly direction, i.e., the flames are forced in the direction from the top of the layer to the bottom. This is accomplished by providing a second burning station 16 adjacent the first burning station 14, and separated only by a low wall or divider 40 so that the flames in the first burning station can readily leap across the wall. This second burning station 16 also employs a grate 42 and the inventive air-injection tubes 30, 32 to promote complete combustion of the waste materials that are piled onto the grate 42 after having been fed in through feed inlet 44. A burner 46 is provided to aid the burning of the waste material and the like which has been fed through the additional rubbish feed inlet 44. In the present invention it is important that the direction of flow of the waste gases and of the flames in the second burning station 16 be in a downward direction through the grate 42, while the direction of flow of the flames and gases in the first section 14 is upwards. This is important in order to encourage an increase in the burning temperature of the medium in both sections, as well as throughout the mass of the medium. As the flames and gases rise through the burning medium in the first burning station 14, the flame and burning of the medium therein is encouraged from the bottom up to the top and along the top by the action of the air injection tubes 30, 32 and the blower 26. As the gases then flow from the first section 14 across the separator 40 to the second burning station 16, the heat and flames of the burning medium of the first burning station 14, are transferred to and jump to the top of the burning medium residing on the second grate assembly 42 of the second burning station 16. The downward flow in the second burning station is encouraged by a fresh air blower 47.

Because the direction of the flow of the flames and waste gases in the second section 16 is in a downwardly direction, there is a tendency for the burning medium of the second section to burn more rapidly at the lower portions than at the upper. To encourage a more even burning of the medium residing on the grate assembly 42 in the second burning station 38 the blower 47 and the air-injection tubes 30, 32 serve to distribute oxygen to the top surface of the burning medium and also to promote combustion. The flames jumping over from the first burning station 16 combine with the oxygen being admitted from the air-injection tubes 30, 32 to create a fire across the top of the burning medium residing on grate 42.

The air being injected or permeating the interior mass of the burning medium on the grate 42 in the second burning station 16 by passing outwardly therefrom through holes 36 in the air-injection tubes encourages the burning of the interior of the medium in the second burning station 16. Since the gases from the first burning station 14 must pass through the hot ashes and coke from the medium burning in the second burning station 38, the temperature of the exhaust gases from the first station is raised substantially. This layer of heated coke is frequently between three and five feet in depth. Also, the time during which these gases are in contact with the burning medium and the ashes and coke thereof is greatly increased, aiding in the filtering and scrubbing of pollutants from the waste gases.

Thus, what takes place is that the burning medium in the second section 16 is subjected to a fire at the middle caused by the injection of air, at the top from the burner 46 and the flames leaping over from the first burning station 14, and at the bottom from the action of the draft of the entire assembly. The waste gases exiting from the lower portion of the second burning station 16 are in a downward direction and will strive to be exhausted by a flue or chimney. The downward flow of these gases is encouraged and increased by the use of the additional air booster or blower 47. The waste gases flowing downwardly and outwardly from the second burning station also encourages the burning of the bottom surface of this medium. This medium at the bottom then burns upwardly toward the top, and the top burns downwardly toward the bottom, while all the time the middle is being encouraged in its combustion by the air which is being injected therein by the air-injection tubes 30, 32.

As the waste gases flow from the first burning station 14 through the second burning station 16, the second section will have a substantial layer (up to 3–5 feet) of burned coke of extremely high temperature resulting from the burning of the medium thereat, as encouraged not only by the draft of the system but also from the flames from the first section. This burned coke layer residing on the grate 42 forms a bed that functions as a filter to purify waste gases that must flow therethrough in a downward direction, including the waste gases produced by the burning in the second section. As the waste gases flow downwardly through the coke of the burned medium, they are filtered mechanically by the porous coke and are subjected to intense heat by the superheated coke to burn off pollutants that are normally entrained in the gases. Hence, the waste gases passing through the burned coke of the medium and are cleaned and become substantially free of noxious pollutants.

One of the novel features of the present invention resides in the ability to produce a filtering bed of coke of burned medium of extremely high temperature through which waste gases must flow in a downwardly direction before they can be exhausted into the atmosphere and it is noted that this bed of hot coke can be formed by burning coal, wood, or charcoal and it is not necessary to burn refuse or waste material. After the waste gases are cleansed by the filtering bed of coke in the second burning station 16 the gases are then diverted upwardly through the chimney 50 into the atmosphere. An auxiliary air booster or fan 51 can be included in chimney 50 to aid the draft of the incinertor and to increase the drawer of the chimney 50. The present invention provides two paths through which the exhaust gases can be connected to the chimney 50. The first path is through an exhaust pipe 52 that has a flapper valve 54 to control the exit of the gases therethrough. Alternately, the gases can be passed through a heat exchanger section, in which case the gases enter what may be termed an ash chamber 56 and then exit through an exhaust tube 58 connected to the chimney 50 by a flapper valve 60. In either event, the particulate in the exhaust gases and the ashes from the combustion in the combustion section 36 will fall through the chamber 56 and be suitably distributed into ash pits represented typically at 62. In the event that the heat exchanger section is to be employed, then flapper valve 54 will be closed and flapper valve 60 will be opened, thereby causing the exhaust gases to flow down exit pipe 63 into the ash chamber 56, through the exhaust pipe 58, past flapper valve 60, and out chimney 50. In this fashion the chamber 56 is heated and is available for use with a suitable heat exchanger, as represented schematically by the heat exchanger tubes 64.

Once the system is in operation it will be necessary to remove ashes following the combustion, and this is accomplished by the positioning of a suitable container 66 beneath the ash pits 62. Communication between the ash pits 62 and the container 66 can be accomplished by doors, shown typically at 68. Similarly, it may be required to perform certain maintenance functions on the burning stations themselves, in which case doors, shown typically at 70, are provided on the top of the incinerator for access by maintenance personnel.

Figure 2:
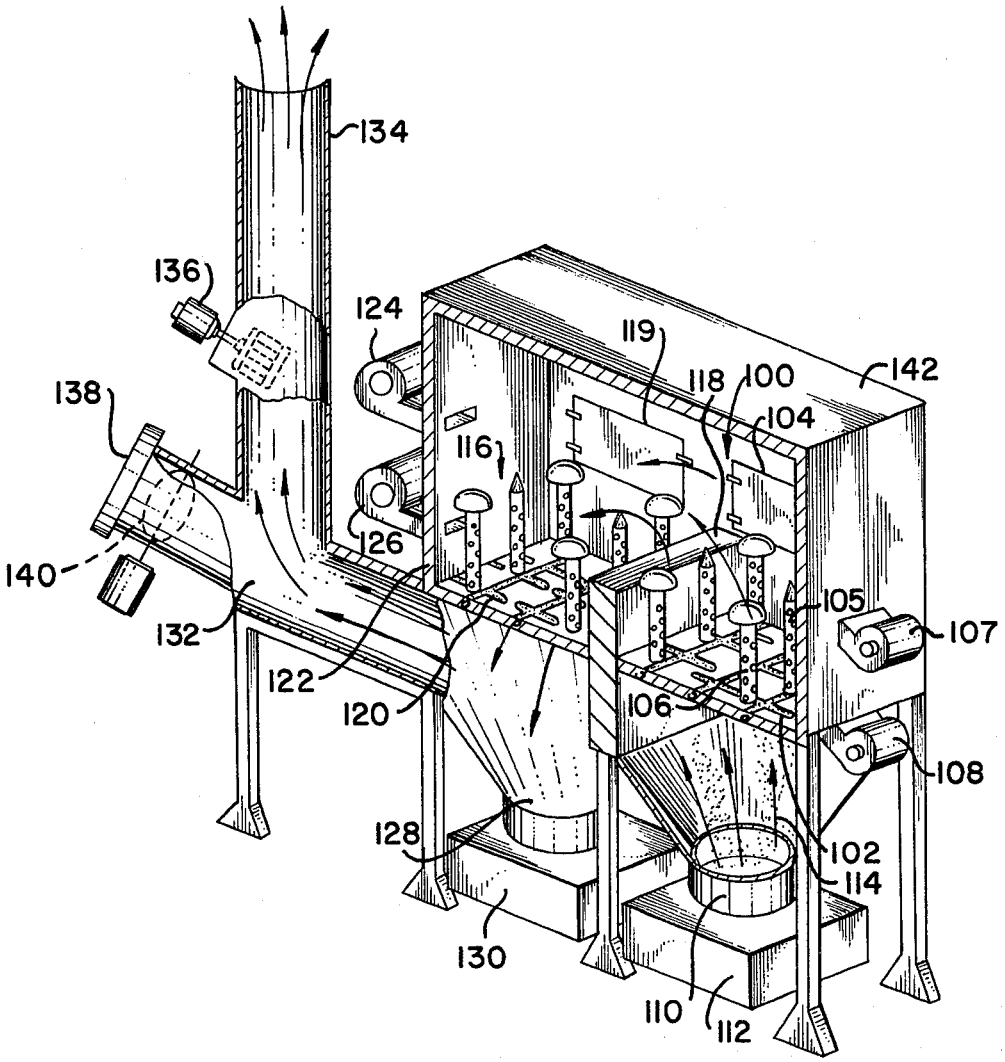
FIG. 2 is a perspective view of an incinerator in partial schematic form, showing the present invention.

FIG. 2 shows another embodiment of the present invention similar to that of FIG. 1. Specifically, a smaller, self-contained incinerator having a single combustion chamber with two burning stages is provided, wherein the second stage involves a downward flow of flames and gases through a layer of superheated coke and ash in order to filter and scrub the pollutants from the exhaust gases. Specifically, a first burning stage, shown generally at 100, is provided and employs a grate 102 to retain the rubbish and waste material to be combusted and which is fed in through a door 104. The air-injection tubes 105, 106 are employed to provide air to the middle and top of the layer of burning rubbish and ash which is supported by the grate 102. A burner 107 is provided to start the fire and to raise the temperature initially to combust the materials, and a blower 108 is provided to supply fresh air to aid the combustion of the burning refuse. An ash pit, represented by the funnel-like arrangement 110 and a suitable container 112 are located beneath the grate 102. The arrows 114 represent the upward flow of air through the grate 102 and indicate the general direction of burning of the refuse located in the first burning stage 100, i.e., from bottom to top.

The second burning stage 116 is separated by a low wall or divider 118 from the first burning stage 100 and is substantially identical to the first stage, i.e., it employs a door 119 through which the materials to be burned are fed, a grate 120 upon which the waste materials initially are supported, and the air-injection tubes 105, 106 for promoting combustion throughout the layer of burning material. The divider 118 is sufficiently low so as to permit the flames from the first stage to leap over onto the material in the second stage. A blower 124 injects fresh air to promote burning and a booster burner 126 is provided to initiate the combustion of the materials fed in through door 119. The second stage 116 is provided with an ash pit 128 and a container 130 to receive the ashes. The outlet of the incinerator includes an exhaust conduit or flue 132 which is connected to the main chimney of flue 134. The chimney 134 can employ a heat exchanger inserted therein to utilize the residual heat which normally would be lost up the chimney. A booster blower 136 is employed to aid drawing the gases up the chimney 134, and an auxilliary outlet 138 is provided in connection with an automatic flapper valve chimney 134, and an auxilliary outlet 138 is provided in connection with an automatic flapper valve 140. The auxilary outlet 138 is for future use for connection to a heat exchanger to extract heat from the exhaust gases. Similarly, the entire chamber shown generally at 142, surrounding both burning stages can be provided with double walls or the like so that the entire chamber can also be utilized in a heat exchanger to perform work from the heat given off by the burning of the materials.

In operation of the embodiment of FIG. 2, again the fire in the first burning stage 100 burns in an upwared direction and the flames and waste gases are forced by the blowers and natural convections to flow upward and over onto the top of the burning materials in the adjacent combustion chamber 116, thereby causing the materials therein to burn in a downwardly direction so that the fire being supported on grate 120 burns downwardly and, thus, the exhaust gases from the first stage 100 are caused to pass through the super-heated coke and ashes in the second stage 116 and are permitted to exit through the chimney only after having been raised to a higher temperature than normally possible and maintained at such higher temperature for a longer period of time than possible with a single burning stage. The second stages will tend to be self-cleaning, since the waste gases produced thereat will flow through the coke before being exhausted up the chimney.

Figure 3:
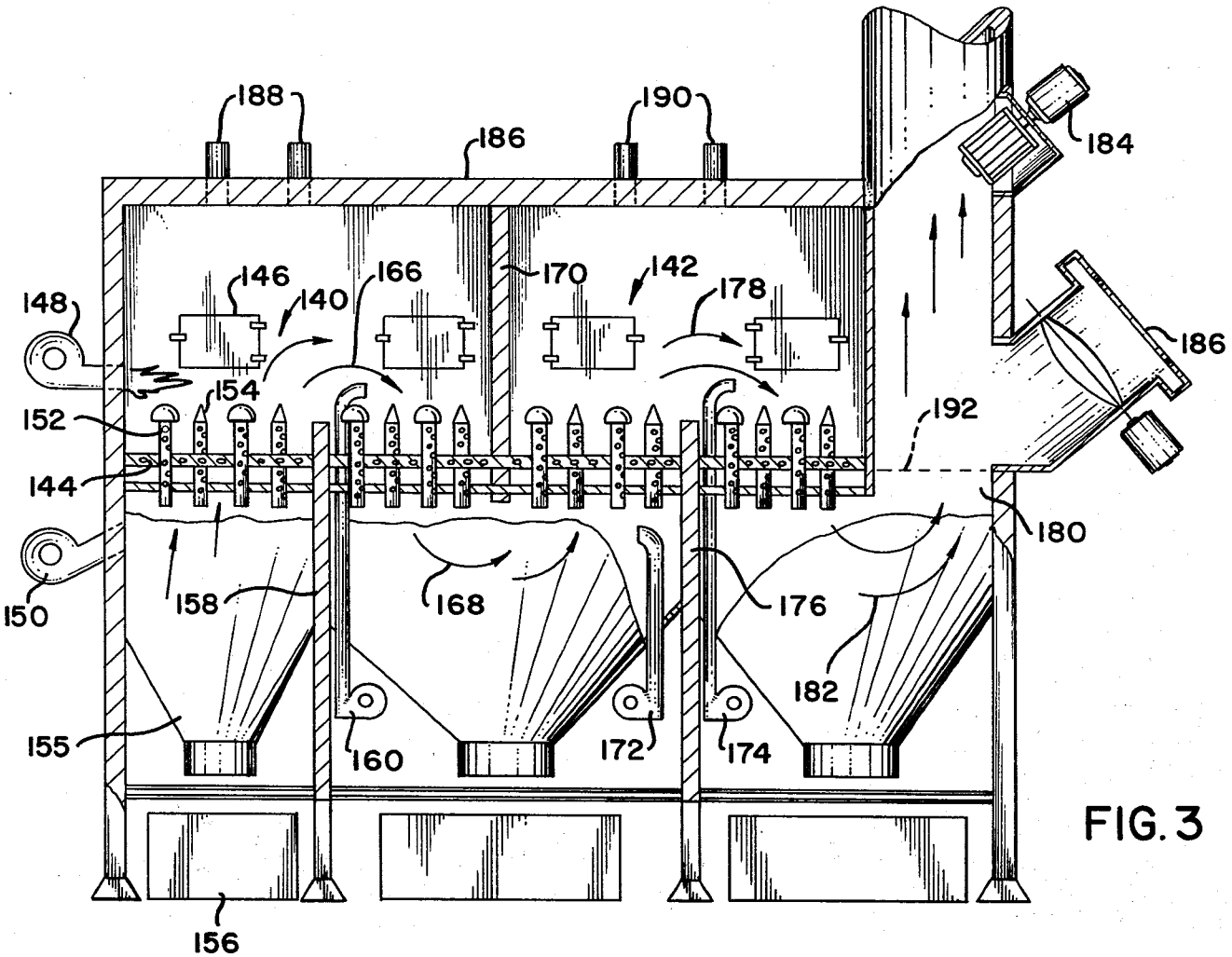
FIG. 3 is a schematic representation of a side elevation of an incinerator having a plurality of burning stations, as taught by the present invention.

Referring to FIG. 3, another embodiment of the present invention involving a multiple stage incinerator is disclosed, wherein the exhaust gases are repeatedly passed in a downward direction through high-temperature burning material and coke. The embodiment of FIG. 3 involves two separate and distinct burning chambers 140 and 142. Each chamber possesses the upward and downward burning modes so that the waste gases from the first burning station pass downward, upward, and downward again before finally being exhausted through the chimney. Thus, the exhaust gases are exposed to extremely high temperatures and for a relatively long period of time. As in the above-described embodiments, the first chamber 140 employs a grid work arrangement 144 upon which rubbish and the like can be burned after it has been fed into the chamber through door 146. The burning in the first section of chamber 140 is initiated by a burner 148 and combustion is promoted by the injection of fresh air through a fresh-air booster blower 150. The blower 150 acts in conjunction with air-injection tubes 152, 154 to promote combustion throughout the relatively thick layer of burning material and red-hot coke. The ashes and the like following combustion in this portion of the chamber may fall down into a suitable ash pit 155 for ultimate removal therefrom into a container 156. The sections of the first burning chamber 140 are separated by a short wall or separator 158 and the second burning station of chamber 140 is substantially structurally identical to the first. The refuse and the like is placed on a grate for burning, however, in turally identical to the first. The refuse and the like is placed on a grate for burning, however, in this burning station such burning is accomplished in a top to bottom or downward direction, based upon the air and gas flow within the chamber 140. A booster pump 160 is provided to add fresh air to insure that combustion is thorough. The waste gases and flames from the first burning station will go in the direction shown generally by arrows 166 and the waste material will burn in a generally downward direction, from top to bottom. The waste gases from the second burning station of chamber 140 will go in the direction as shown by arrows 168 and, thus, enter second chamber 142 from the bottom. Chamber 142 is separated from chamber 140 by a suitable fire wall 170. Combustion chamber 142 is substantially identical to chamber 140 and employs fresh-air blowers 172 and 174 to provide additional air to aid combustion.

Of principal interest is the path the exhaust gases are forced to follow. That is, the flames and gases in the first burning station of chamber 142 are in an upward direction, as indicated by arrows 168. The gases and flames must pass over a short separating wall 176 and into the second burning station of chamber 142, as indicated by arrows 178. The burning and gas flow are in a downward direction in this section of chamber 142 and, finally, the gases are caused to flow down and out into the chimney 180, as shown by arrows 182. The chimney 180 can employ a booster pump 184 to aid the drawing of the gases up the flue and also an outlet 184 for future use in conjunction with a heat exchanger.

With respect to a heat exchanger, the entire structure 186 surrounding or forming the shell of the incinerator may function as a heat exchanger, as represented by heat exchanger pipes 188 and 190. Thus, in the embodiment of FIG. 3 employing the multiple burning stages, the gases from the first burning station flow upwardly and cross over, as shown by arrows 166, into the second section which burns in a downwardly direction and the gases therefrom flow upwardly through the first section of a separate combustion chamber 142. The gases from this first section cross over, as shown by arrows 178, and down through the second section and ultimately up the chimney, as shown by arrows 182. These multiple passes will not only elevate the temperature of the exhaust gases by repeated contact with the super-heated coke and ashes produced by the burning refuse, but also such elevated temperatures can be held for a substantial length of time due to these multiple passes. As in the embodiments it is the passing of the waste gases through the beds of very hot coke that is important and the coke beds may be formed by having any suitable material, e.g., coal, charcoal, rubbish, etc.

To provide additional filtering a fine mesh grate, shown by dashed lines 192, can be added. Alternatively, a final burning station could be also located there. This burning station would burn in an upward direction, so that prior to being exhausted the waste gases would pass through an upwardly burning mass.

Figure 4:
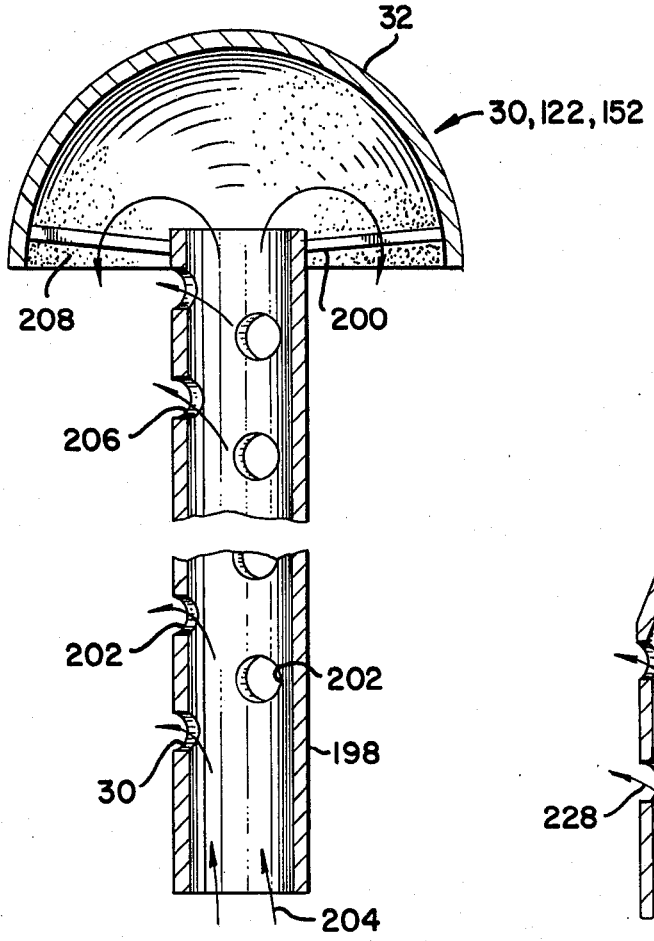
FIG. 4 is a cross-sectional view of a perforated air-injection tube having a shield element affixed thereto.

FIG. 4 shows a detail of one of the air-injection tubes in cross section. This air-injection tube corresponds to the one having a cap or shield, as shown at 30, 122, 154 in the preceding figures. These tubes may be formed of a length of suitably heavy gauge pipe or tubing 198, and the cap or shield 32 can be attached to the main tube by three equally spaced supports or ribs, shown typically at 200. The perforations, shown typically at 202, in the tube can be equally spaced and should be of suitable size so as not to be plugged easily and to provide adequate air flow. The air flow in the air-injection tube assembly 30 proceeds upwardly through the bottom of the tube 198, as indicated by arrows 204 and then exits both through the apertures or holes 202, as shown by arrows 206, and out of the top of the tube, as shown by arrows 208.

Figure 5:
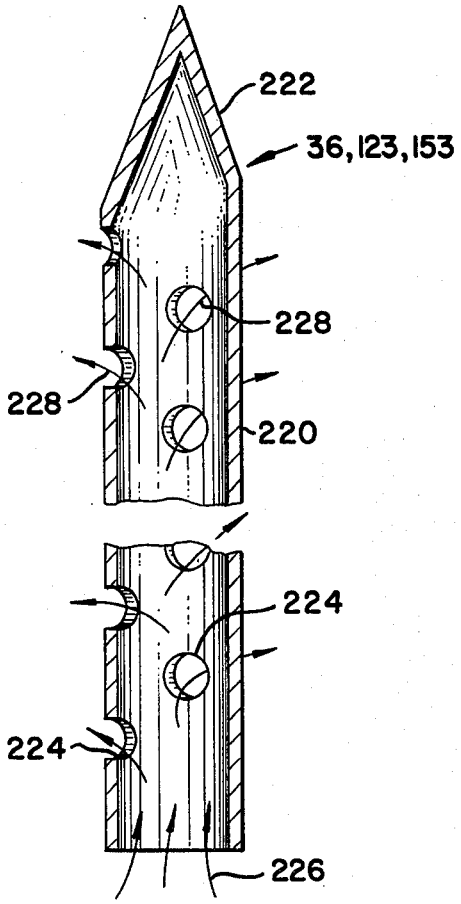
FIG. 5 is a cross-sectional view of a perforated air-injection tube having a closed, pointed upper end.

FIG. 5 shows the other style of air-injection tube taught in the present invention. This is the pointed tube shown at 36, 123, 154 in the preceding figures. In this embodiment, a suitably heavy gauge pipe or tube 220 is provided with a pointed end 222, which can be integrally formed or welded onto the tube. As in the shielded tube of FIG. 4, a number of apertures, shown typically at 224, are formed in the wall of the tube 220. Air flowing into the bottom of the tube, as shown by arrows 226, can exit only through the apertures 224, as shown by arrows 228. The shield on the air-injection tube of FIG. 4 is provided to prevent debris and rubbish from entering and clogging the pipe, however, if enough rubbish or ashes are present to cover the air-injection tube and occlude the apertures then all of the air will be forced to exit from the top of the tube, i.e., from beneath the shield. This will defeat the purpose of injecting air into the center of the burning mass. To take care of that situation, the embodiment of FIG. 5 is provided for use in combination with the shielded-end tubes. Because of the closed pointed end 222, all air entering the tube 36 must exit through the apertures 224, thereby causing the apertures 224 to be self-clearing, so that even if the rubbish or ash is piled over the top of the air-injection tube air will still be injected into the center of the layer of burning material.

Figure 6:
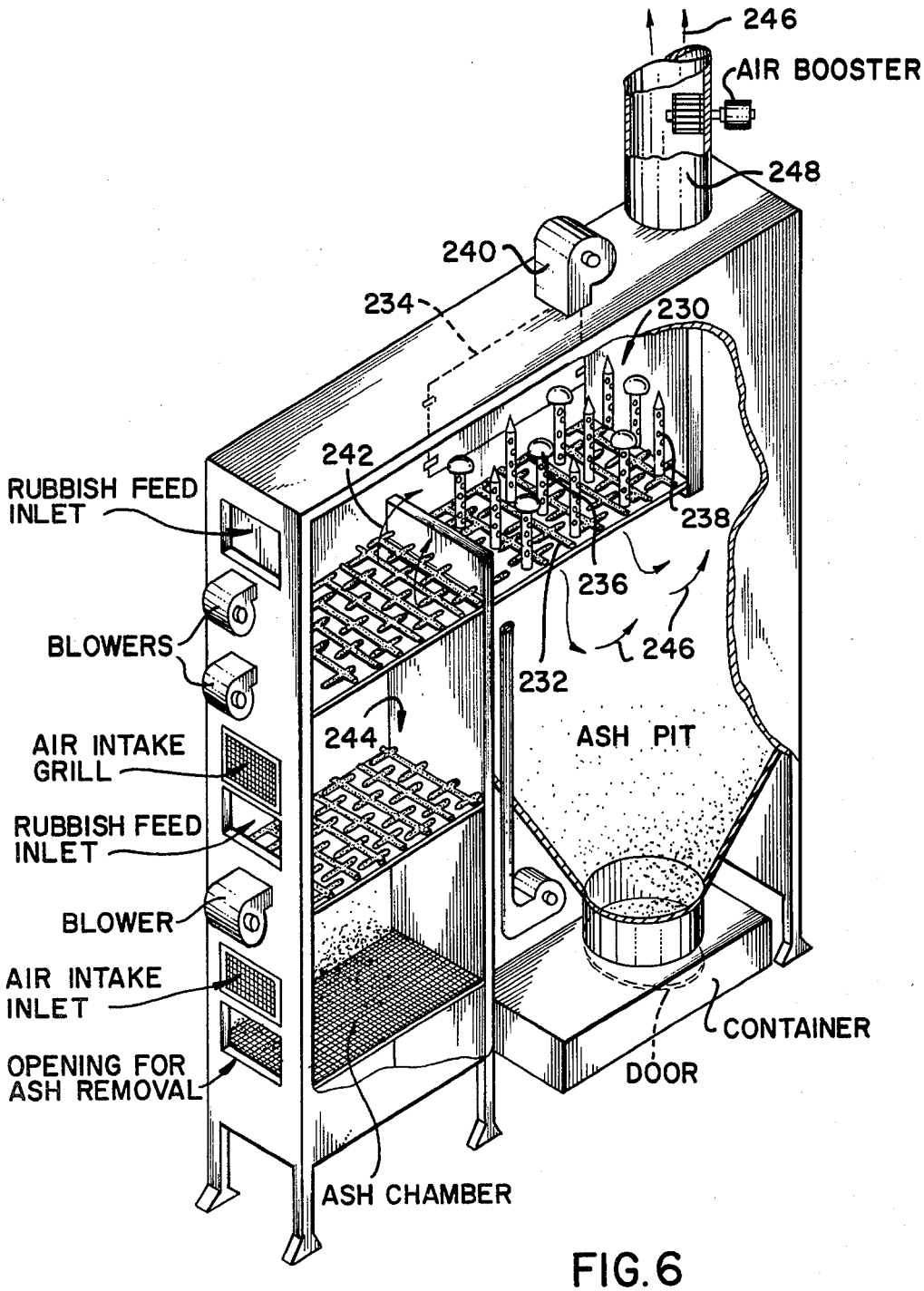
FIG. 6 is a perspective view of another embodiment showing a multi-levr end.

Referring now to FIG. 6, still another embodiment of the present invention is shown. In this embodiment, an incinerator has a number of vertically arranged burning stations. The burning stations are arranged one above the other instead of sequentially in a horizontal plane, as in the previously described embodiments. In this embodiment, the present invention provides an additional stage wherein rubbish is burned between the top or uppermost stage of the incinerator and the exit path up the flue or chimney. The additional stage, shown generally at 230, employs a grating 232 for supporting the rubbish and waste materials to be burned that have been thrown into the chamber through inlet door 234. The air injection tubes 236, 238 of the previous embodiment are also employed. An additional blower 240 to aid the burning of these materials and generally to cause the burning to be in a downward direction is arranged at the top or on the roof of the incinerator.

The operation of this embodiment is such that the burning of the waste material takes place in the vertical chambers and the flames and exhaust gases from this burning are caused to pass down onto the top of the waste materials that has been placed in the burning station 230 provided by the present invention, as shown by arrows 242. The additional stage 230 and the adjacent existing burning station 244 are separated only by a low wall over which the flames may readily pass to ignite and burn the waste materials or other fuel on grating 232. The specific construction of the burning chamber in relation to the flue causes the materials in the chamber 230 to burn in a downward direction, thereby forcing the exhaust gases to flow in the direction shown typically by arrows 246, whereupon the exhaust gases flow upwardly out the chimney 248. The draft of the system and the flow up the chimney can be aided by a blower 250.

It is understood that the foregoing is presented by way of example only and is not intended to limit the present invention except as set forth in the appended claims.

I claim:

1. An incinerator for burning waste material which, when burned, produces gases within which pollutants are entrained and which waste material, when burned, becomes a burning coke, said incinerator comprising:

at least one combustion chamber;

at least two burning stations in substantial side-by-side relation located in said at least one combustion chamber and comprising grate means for receiving and retaining material including waste material for burning thereon;

inlet means for the reception of waste material into said at least one combustion chamber for disposition on said grate means of said burning stations;

means for burning waste material disposed on said grate means of said burning stations;

said burning means including means for conducting air to and through the burning waste material on said grate means of said burning stations and means for directing the flames and gases from the material burning on said grate means of one of said burning stations to the material burning on the grate means of the other of said burning stations;

said conducting means also comprising means for conducting gases from the material burning on said grate means to and through the burning material on said grate means of said other of said burning stations;

said conducting means thereby constituting combustion aiding means for substantially increasing the temperature in the burning material on said grate means of said other of said burning stations to burn off pollutants entrained in and to thereby clean the gases; and conduit means for passing the gases which have been conducted through the burning material on said grate means of said other burning station to the atmosphere.

2. The incinerator of claim 1 wherein said conducting means comprises means for directing air through the material burning on said grate means of said one of said burning stations in a substantially upward direction, means for directing air, the flames and gases from the material burning on said grate means of said one of said burning stations laterally to the material burning on said grate means of said other of said burning stations and means for directing the air and gases directed from said one of said burning stations and flames in the material burning on said grate means of said other of said burning stations substantially downwardly.

3. The incinerator of claim 1, wherein said conducting means comprise tube means supported by said grate means for extending through burning waste material disposed thereon for conducting air and gases to, into and through the interior thereof.

4. The incinerator of claim 3, wherein said tube means comprise a plurality of perforated tubes comprising first perforated tubes, each having an open lower end and a closed upper end, and second perforated tubes, each having an open lower end and an open upper end, and shield means arranged in spaced-apart relationship with the upper ends of said second perforated tubes.

5. The incinerator of claim 1, further comprising a low wall separating said grate means of said one of said burning stations from said grate means of said other of said burning stations, said low wall being of the height so that flames from the burning waste material burning on said grate means of said one burning station can traverse said low wall and impinge on the burning waste material on said grate means of said other of said grate means.

6. The incinerator of claim 1, wherein said means for burning the waste material on said grate means of said one of said burning stations includes a burner and means for directing air.

7. The incinerator of claim 1, wherein said conducting means includes air directing means for injecting fresh air into the combustion chamber and upon, into and through the burning waste material on said grate means of said other of said burning stations.

8. The incinerator of claim 1, further comprising:

at least one further combustion chamber separate from said first combustion chamber and having at least one further burning station in said further combustion chamber comprising grate means for receiving and retaining material including waste material for burning thereon;

inlet means for reception of waste material into said at least one further combustion chamber for disposition on said grate means of said at least one further burning station;

means for burning the waste material on said grate means of said at least one further burning station;

said conduit means including intermediate conduit means for passing the gases which have been conducted through the burning material in said at least one combustion chamber to said grate means of said at least one further burning station;

and further conducting means supported by said grate means of said at least one further burning station for conducting the gases passed by said intermediate conduit means into and through the burning material on said at least one further burning station.

9. The incinerator of claim 8, further comprising a second burning station in said further combustion chamber in substantial side-by-side relation with said at least one burning station and comprising grate means for receiving and retaining material including waste material for burning thereon and including said further conducting means supported thereby;

said further conducting means supported by said at least one further burning station and by said second burning station comprising means for conducting gases from said intermediate conduit means to and through the burning material on said grate means of said at least one further burning station and for conducting gases from said at least one further burning station to and through the burning material on said grate means of said second burning station.

10. The incinerator of claim 8, wherein said further conducting means comprise tube means supported by said grate means for extending through the burning waste material disposed thereon for conducting air and gases to, into and through the interior thereof.

11. The incinerator of claim 10, wherein said tube means comprise a plurality of perforated tubes comprising first perforated tubes, each having an open lower end and a closed upper end, and second perforated tubes, each having an open lower end and an open upper end, and shield means arranged in spaced-apart relationship with the upper ends of said second perforated tubes.

12. The incinerator of claim 1, including at least one initial burning station for burning waste materials mounted in substantially vertically spaced relationship beneath said grate means of said one of said burning stations of said at least one combustion chamber.

13. The incinerator of claim 12, wherein said conducting means comprise a plurality of air-injection tubes supported by said grate means and having open ends extending beneath said grate means.

14. The incinerator of claim 1, wherein said conduit means is beneath said grate means of said other of said burning stations, and wall means are provided for isolating said conduit means from said grate means of said one of said burning stations, whereby waste gases produced by burning waste material in said combustion chamber must pass through said grate means of said other of said burning stations before being passed to atmosphere.

15. An incinerator for burning waste material placed thereinto and having a flue for exhausting smoke and waste gases produced by the burning, comprising:

a combustion chamber having a plurality of burning stations arranged in substantially side-by-side relation, each comprising means for receiving and burning waste material disposed thereon;

means for forcing flames and waste gases from the burning material on adjacent burning stations in opposite directions, upwardly from one burning station and downwardly from a next adjacent burning station;

means for conducting the gases forced in one direction from the burning material on one burning station to, into and through the burning material on the next adjacent burning station in the opposite direction;

conduit means connected between said combustion chamber and the flue and in fluid communication with the last of said plurality of burning stations; and means for isolating said conduit means from all other burning stations, whereby waste gases produced by burning waste material in said combustion chamber pass through said conduit means.

16. A method of incinerating waste material comprising the steps of:

burning waste material on a first grate;

burning waste material on a second grate mounted in substantially side-by-side relation to said second grate and provided with perforated tubes extending above and below the burning waste material thereon;

directing the flames and hot waste gases from the burning material on said first grate to the burning waste material on said second grate and the hot waste gases from the burning material on said first grate through said perforated tubes into and through the burning waste material on said second grate; and directing the hot waste gases resulting from the burning on said first grate and the burning on said second grate towards a chimney.

17. A mehtod according to claim 16 further comprising the step of forcing air upwardly through said first grate and downwardly through said second grate.

18. A method according to claim 17 wherein said step of directing hot waste gases to the chimney further includes the step of diverting a portion of the hot waste gases towards an ash pit en route to said chimney for extracting particulate matter from said hot waste gases to be deposited within said ash pit.

19. A method of claim 16 comprising the steps of:

burning waste material on a set of grates mounted in substantially side-by-side relation and provided with perforated tubes extending above and below the burning waste material;

directing the flames and hot waste gases of the burning material on each of said grates to the next adjacent grate and into and through the burning material on said next adjacent grate in alternating directions from one grate to the next; and catching particulate matter dropped by hot waste gases from each downwardly directed burning.

20. A method according to claim 19 further comprising the step of directing hot waste gases from the last grate in said series of grates to a chimney for exhausting all waste gases from the burning wast materials via said chimney.

21. A method according to claim 20 further comprising the step of forcing the flames and hot waste gases in their alternating directions by blowing air in the desired directions.

* * * * *